US011771613B2

(12) United States Patent
Song et al.

(10) Patent No.: US 11,771,613 B2
(45) Date of Patent: Oct. 3, 2023

(54) ROBOT SYSTEM FOR ACTIVE AND PASSIVE UPPER LIMB REHABILITATION TRAINING BASED ON FORCE FEEDBACK TECHNOLOGY

(71) Applicant: SOUTHEAST UNIVERSITY, Nanjing (CN)

(72) Inventors: Aiguo Song, Nanjing (CN); Yiting Mo, Nanjing (CN); Huanhuan Qin, Nanjing (CN); Huijun Li, Nanjing (CN); Baoguo Xu, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 582 days.

(21) Appl. No.: 16/970,631

(22) PCT Filed: Aug. 18, 2020

(86) PCT No.: PCT/CN2020/095733

§ 371 (c)(1),
(2) Date: Aug. 18, 2020

(87) PCT Pub. No.: WO2021/068542

PCT Pub. Date: Apr. 15, 2021

(65) Prior Publication Data

US 2021/0346225 A1 Nov. 11, 2021

(30) Foreign Application Priority Data

Oct. 12, 2019 (CN) ..... 201910969686.8

(51) Int. Cl.

| | |
|---|---|
| ***A61H 1/02*** | (2006.01) |
| ***A63B 21/00*** | (2006.01) |
| ***A63B 23/12*** | (2006.01) |

(52) U.S. Cl.
CPC ..... *A61H 1/0274* (2013.01); *A63B 21/00178* (2013.01); *A63B 23/12* (2013.01);
(Continued)

(58) Field of Classification Search
CPC .. A61H 1/0274; A61H 1/0277; A61H 1/0281; A61H 2201/1207;
(Continued)

(56) References Cited

U.S. PATENT DOCUMENTS 5,466,213 A * 11/1995 Hogan ..... A61H 1/02 482/901
9,265,685 B1 * 2/2016 McAmis ..... A63B 21/4035
(Continued)

FOREIGN PATENT DOCUMENTS

CN 103006415 A 4/2013
CN 103519966 A 1/2014
(Continued)

*Primary Examiner* — Quang D Thanh
(74) *Attorney, Agent, or Firm* — Bayramoglu Law Offices LLC

(57) ABSTRACT

A robot system for active and passive upper limb rehabilitation training based on a force feedback technology includes a robot body and an active and passive training host computer system. Active and passive rehabilitation training may be performed at degrees of freedom such as adduction/abduction and flexion/extension of left and right shoulder joints, and flexion/extension of left and right elbow joints according to a condition of a patient. In a passive rehabilitation training mode, the robot body drives the upper limb of the patient to move according to a track specified by the host computer, to gradually restore a basic motion function of the upper limb. In an active rehabilitation training mode, the patient holds the tail ends of the robot body with both hands to interact with a rehabilitation training scene, and can feel real and accurate force feedback.

6 Claims, 4 Drawing Sheets

(52) U.S. Cl.
CPC ..... *A61H 1/0277* (2013.01); *A61H 1/0281* (2013.01); *A61H 2201/1207* (2013.01); *A61H 2201/165* (2013.01); *A61H 2201/1638* (2013.01); *A61H 2201/1659* (2013.01); *A61H 2201/5007* (2013.01); *A61H 2201/5043* (2013.01); *A61H 2201/5061* (2013.01); *A61H 2201/5069* (2013.01); *A61H 2230/625* (2013.01)

(58) Field of Classification Search
CPC ..... A61H 2201/1638; A61H 2201/165; A61H 2201/1659; A61H 2201/5007; A61H 2201/5043; A61H 2201/5061; A61H 2201/5069; A61H 2230/625; A61H 2201/0107; A61H 2205/06; A63B 21/00178; A63B 23/12; A63B 2024/0093; A63B 2024/0096; A63B 2071/0638; A63B 2071/0655; A63B 2220/51; A63B 2220/54; A63B 21/00181; A63B 21/0058; A63B 21/159; A63B 21/4019; A63B 21/4025; A63B 21/4047; A63B 23/1209; A63B 24/0087
See application file for complete search history.

(56) References Cited

U.S. PATENT DOCUMENTS

| | | | | |
|---|---|---|---|---|
| 2012/0029391 | A1* | 2/2012 | Sung | A61B 5/6824 600/595 |
| 2015/0302777 | A1* | 10/2015 | Campolo | G09B 23/28 434/262 |
| 2017/0095391 | A1* | 4/2017 | Sapin | A61B 5/4833 |
| 2019/0258239 | A1* | 8/2019 | Floreano | A61H 1/0285 |

FOREIGN PATENT DOCUMENTS

| | | | |
|---|---|---|---|
| CN | 106779045 | A | 5/2017 |
| CN | 107261417 | A | 10/2017 |
| CN | 107632699 | A | 1/2018 |
| CN | 107714398 | A | 2/2018 |
| CN | 110742775 | A | 2/2020 |
| EP | 1838270 | A2 | 10/2007 |
| WO | 2005075155 | A2 | 8/2005 |

* cited by examiner

ROBOT SYSTEM FOR ACTIVE AND PASSIVE UPPER LIMB REHABILITATION TRAINING BASED ON FORCE FEEDBACK TECHNOLOGY

CROSS-REFERENCE TO THE RELATED APPLICATIONS

This application is the national stage entry of International Application No. PCT/CN2020/095733, filed on Jun. 12, 2020, which is based upon and claims priority to Chinese Patent Application No. 201910969686.8, filed on Oct. 12, 2019, the entire contents of which are incorporated herein by reference.

TECHNICAL FIELD

The present invention relates to rehabilitation robots, and in particular, to a robot system for active and passive upper limb rehabilitation training based on a force feedback technology.

BACKGROUND

With the development of society and the intensification of aging, there is an increasing number of patients with hemiplegia caused by cardio-cerebrovascular diseases or neurological diseases. Therefore, rehabilitation medicine is gradually valued by the society. Researches show that stroke patients can gradually restore the motion function by performing long-term rehabilitation training and obtaining sufficient exercise and sensory stimulation. However, currently, in most cases, medical personnel provide one-to-one assistance to the patient for rehabilitation training, which has a requirement on the economic situation of the patient, and the boring and long-time training also brings a specific psychological burden to the patient. In addition, a rehabilitation training effect mainly depends on subjective judgment of the medical personnel, and there is no data for evaluation. In recent years, there have been some devices that can replace the medical personnel to perform repetitive passive rehabilitation training, which can greatly reduce a physical burden of the medical personnel and allow them to focus more on customizing personalized rehabilitation training programs for patients. However, a device without an active rehabilitation training function is disconnected from daily life and affects an independent living ability of a patient.

A robot system for active and passive upper limb rehabilitation training based on a force feedback technology is designed as an integrated structure without additional somatosensory devices, can provide active and passive rehabilitation training modes, and can play a role in an entire rehabilitation phase of the patient. Passive training actions can be customized according to an actual situation of the patient. In addition, the vivid and abundant active training modes can also alleviate a psychological burden of the patient in a training process. In a process of interacting with a game scene, the system can further provide precise force feedback, to enhance immersion and a sense of reality, thereby improving a training effect.

SUMMARY

An objective of the present invention is to provide a robot system for active and passive upper limb rehabilitation training based on a force feedback technology, to provide repetitive passive rehabilitation training stimulation and active rehabilitation training with force feedback for a patient who needs upper limb rehabilitation.

Technical solution: A robot system for active and passive upper limb rehabilitation training based on a force feedback technology is provided, including:

a robot body, including two multi-degree-of-freedom manipulators for placing hands of a patient and a motor unit, where a force/torque sensor is mounted on a tail end of the manipulator; and an active and passive training host computer system for active rehabilitation training and/or passive rehabilitation training, where when the system provides the passive rehabilitation training, the hand of the patient is supported by the tail end of the manipulator, and the system calculates an expected position track of the tail end of the manipulator into a motion angle of a motor according to a rehabilitation training action, and controls the manipulator to draw the upper limb to complete a training task set by the system; and when the system provides the active rehabilitation training, the manipulator serves as an interface for man-machine interaction, and visual feedback and force feedback are provided by a man-machine interaction interface and the force/torque sensor, to complete a task in a virtual rehabilitation training scene.

Further, the robot body is worn on a human body by using a detachable part. The detachable part is preferably a belt, and the two multi-degree-of-freedom manipulators are respectively mounted on two sides of the belt.

Further, the passive rehabilitation training specifically includes the following content:

calculating, by the system according to the rehabilitation training action, the expected position track of the tail end into motion angles of six motors by using an inverse kinematics calculation formula of the manipulator, and storing the motion angles;

driving, by the manipulator, the upper limb to perform training according to a specified rehabilitation action until a specified quantity of times of training is reached; and analyzing an accuracy level of the action of the upper limb of the patient according to feedback information from the motor in a training process, and scoring a rehabilitation effect, to obtain a line graph of the passive rehabilitation effect of the patient after the rehabilitation effect is scored a plurality of times. The feedback information from the motor includes an angle and/or a current.

Further, the active rehabilitation training includes visual feedback rehabilitation training and force feedback rehabilitation training, where:

the visual feedback rehabilitation training is that: the man-machine interaction interface of the system displays a scene of a rehabilitation training task and virtual hands of the patient, positions of the virtual hands change with positions of the hands of the patient, the positions of the virtual hands are obtained through calculation by the system by using a forward kinematics calculation formula of the manipulator according to angle information of the six motors, and the man-machine interaction interface continuously updates the positions of the hands of the patient to provide visual feedback information for the patient; and the force feedback rehabilitation training is that: the hand of the patient controls, by using the tail end of the manipulator, the virtual hand in the man-machine interaction interface to collide with a virtual object, the system calculates force/torque information generated through the collision according to an algorithm, and allocates the force/torque to the motors through statics analysis of the manipulator, and the manipulator presents a force on the upper limb of the patient, allowing the patient to feel the force during active rehabilitation training.

A rehabilitation condition of the upper limb of the patient is analyzed according to information recorded in a training process, and a rehabilitation effect is scored, to obtain a line graph of the active rehabilitation effect of the patient after the rehabilitation effect is scored a plurality of times.

Compared with the prior art, the present invention has the following significant advantages: 1. The robot system for active and passive upper limb rehabilitation training based on a force feedback technology of the present invention does not require an additional somatosensory device, and the robot system itself is a medium for bidirectional interaction between the patient and the rehabilitation training scene. Flexibility of the upper limbs of the patient can be gradually enhanced through active and passive rehabilitation training. 2. In the active training process, the system provides real-time force feedback for the upper limb by using the manipulator according to the interaction between the patient and the rehabilitation system, and improves the rehabilitation training effect through dual stimulation of the visual information and the force information. 3. The robot has a compact structure, is light, is easy to wear, and has low costs. Compared with a conventional manner, a training process is more efficient, and participation enthusiasm of the patient is higher, which has important research significance and a practical value for improving the effect of upper limb rehabilitation training.

DETAILED DESCRIPTION OF THE EMBODIMENTS

The technical solutions of the present invention are described in detail below with reference to the accompanying drawings and specific implementations.

Figure 1:
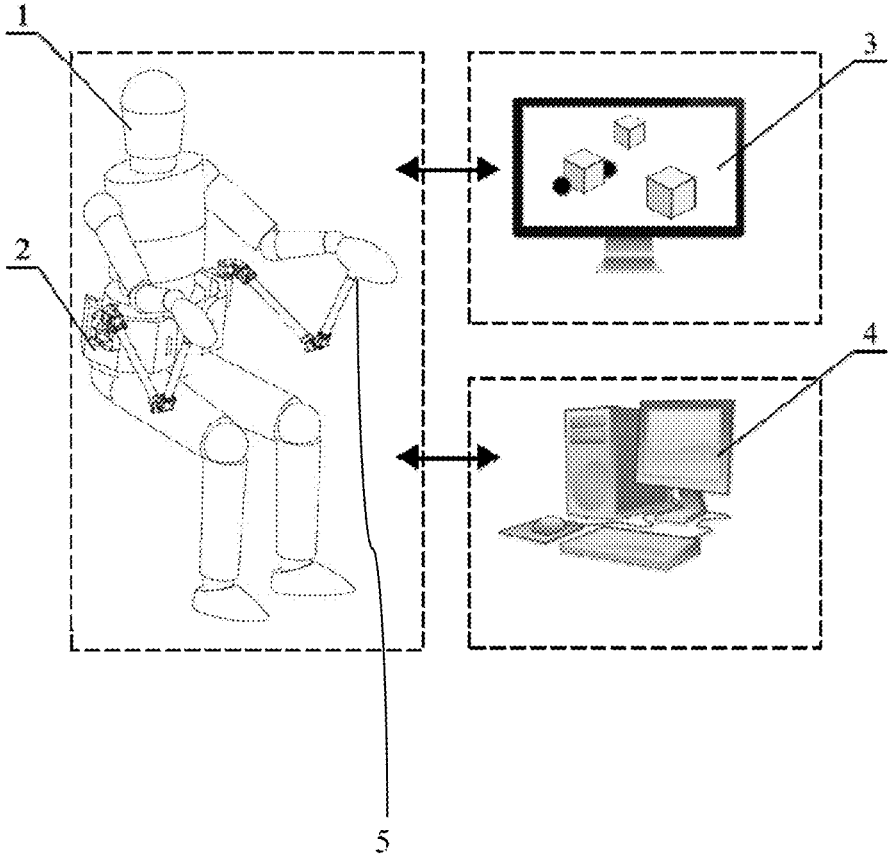
FIG. 1 is a schematic structural diagram of a three-degree-of-freedom robot system for active and passive upper limb rehabilitation training according to the present invention.

As shown in FIG. 1, a robot system for active and passive upper limb rehabilitation training based on a force feedback technology includes a robot body 2 and an active and passive training host computer system. The robot body 2 includes two three-degree-of-freedom manipulators and six motor units configured to drive the manipulators. A patient 1 wears the robot body 2 on the waist by using a rigid belt. Preferably, tightness of the rigid belt can be adjusted by using a velcro tape. Human hands hold tail ends 5 of the two manipulators extending from two sides of the belt, and a force/torque sensor is mounted on the tail end of the manipulator. The active and passive training host computer system includes an active rehabilitation training host computer 3 and a passive rehabilitation training host computer 4.

There is bidirectional data transmission between the robot body 2 and the passive rehabilitation training host computer 4. The host computer transmits control instructions for the six motors to the robot body, and motor data (such as an angle and a current) of the robot body 2 is fed back to the host computer. There is bidirectional data transmission between the robot body 2 and the active rehabilitation training host computer 3. The robot body 2 transmits data of the six motors and the force/torque sensor to the host computer, and the host computer transmits data for controlling the motors to the robot body. When the system provides passive rehabilitation training, the patient holds the tail ends of the manipulators with both hands, and the manipulators draw the upper limbs to complete long-time and highly repetitive training tasks. In this case, the manipulator plays a role in supporting the passive rehabilitation training. When the system provides active rehabilitation training, the patient holds the tail ends of the manipulators with both hands and completes some tasks in a virtual rehabilitation training scene with visual feedback and force feedback. The design of man-machine integration enables the robot system for active and passive upper limb rehabilitation training to help the patient perform a large quantity of active and passive rehabilitation training by using the two manipulators extending from the waist as an interface for man-machine interaction without an additional somatosensory device, and has an important application value for upper limb rehabilitation training.

Figure 2:
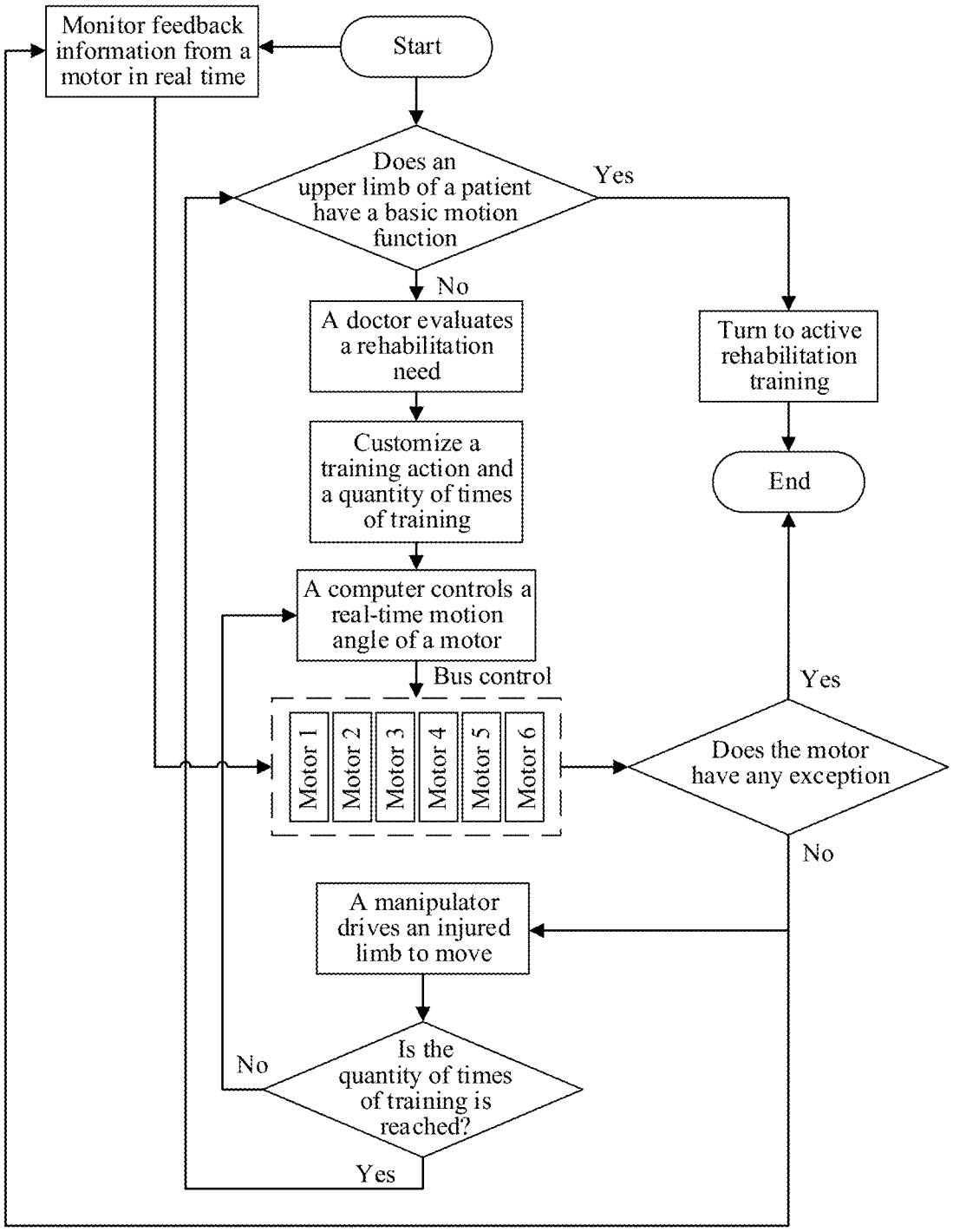
FIG. 2 is a flowchart of a use method of passive rehabilitation training according to the present invention.

FIG. 2 is a flowchart of a use method of passive rehabilitation according to the robot system for active and passive upper limb rehabilitation training based on a force feedback technology. In an early stage of rehabilitation training, the patient has an inadequate muscle group function and poor coordination between joints, and therefore, a large quantity of repetitive passive rehabilitation training needs to be performed first. First, the medical personnel perform basic examination on the patient to determine whether the upper limb of the patient has a basic autonomous motion function, and if not, the medical personnel evaluate rehabilitation needs of the patient for upper limb functions such as shoulder joint adduction and abduction, shoulder joint extension and flexion, elbow joint flexion and extension, and customize a training action and a quantity of times of training for the patient. Passive rehabilitation training host computer software calculates angles of joints of the two manipulators according to a track of the training action, and sends instructions to the motors through a bus. The patient wears the robot body on the waist, performs adjustment by using the velcro tape, and holds the tail ends of the manipulators with both hands. The manipulators drive the upper limbs to move until the quantity of times of training is reached. An accuracy level of the action of the upper limbs of the patient is analyzed according to feedback information from the motor in a training process, and a rehabilitation effect is scored. After the rehabilitation effect is scored a plurality of times, a line graph of the passive rehabilitation effect of the patient can be obtained. States of the motors are monitored throughout the process. If there is any exception (such as excessive feedback current), power cutoff is automatically performed to ensure patient safety.

Figure 3:
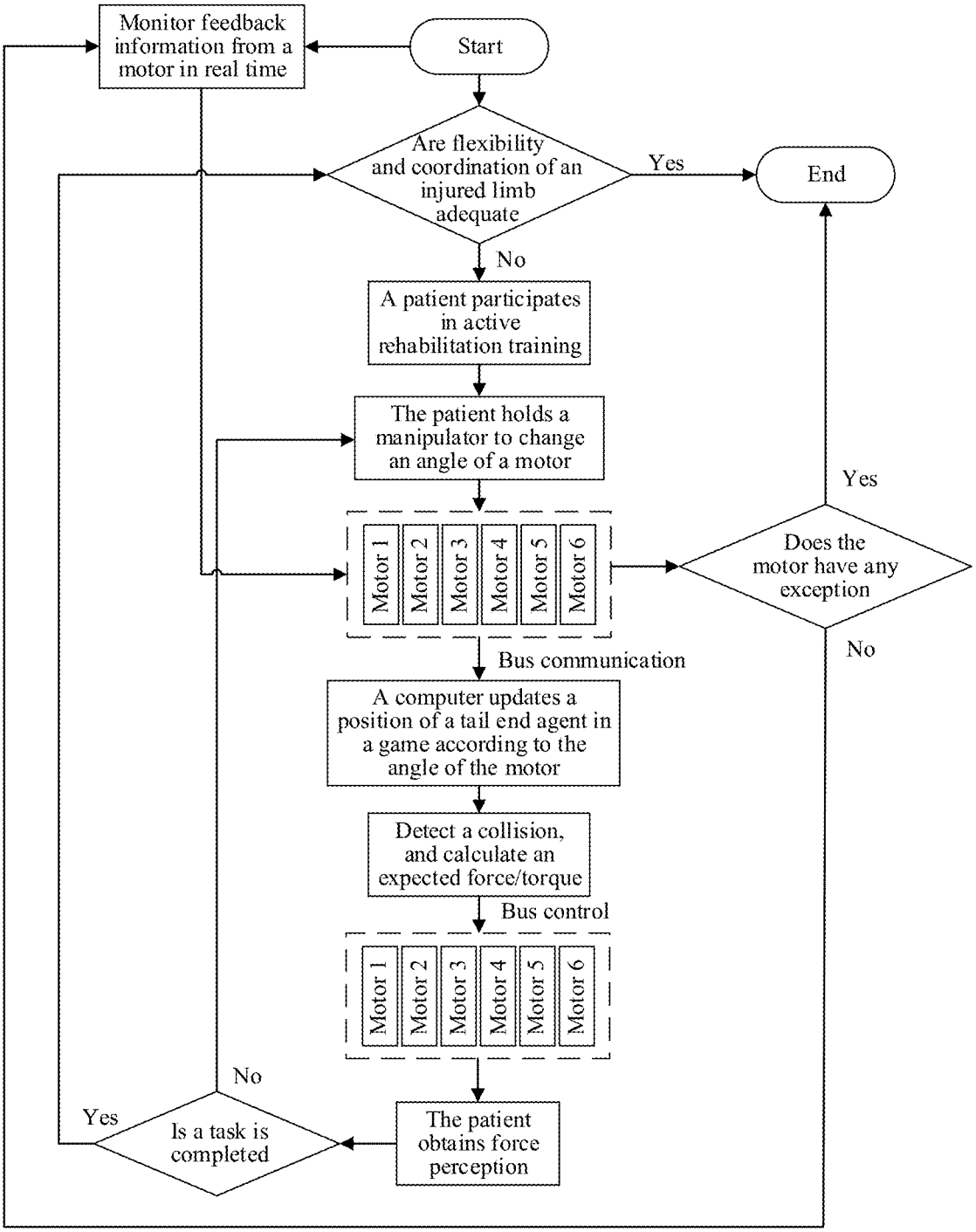
FIG. 3 is a flowchart of a use method of active rehabilitation training according to the present invention.

FIG. 3 is a flowchart of a use method of active rehabilitation according to the robot system for active and passive upper limb rehabilitation training based on a force feedback technology. After the patient performs long-term passive rehabilitation training, the muscle group capability and the joint function of the patient are greatly restored, and the basic motion ability is regained. In this case, the patient needs scientific active rehabilitation training to improve flexibility of the upper limbs. First, the medical personnel determine flexibility and coordination of the upper limbs of the patient through simple tests. If rehabilitation treatment is needed, a proper rehabilitation training task is designed according to a specific condition. For example, the training task may be performed in the form of game interaction. In the active rehabilitation training process, no additional somatosensory device is needed. The manipulator is an interface for man-machine interaction between the patient and a rehabilitation game. The patient holds the tail ends of the manipulators, and the active rehabilitation training host computer displays a rehabilitation training game scene in a man-machine interaction interface (a computer screen). Two small balls may be used as agents of two hands in the scene, and positions of the small balls change with positions of the hands. The positions of the small balls are obtained through calculation by the system by using a forward kinematics calculation formula of the three-degree-of-freedom manipulator according to angle information of the six motors. The patient controls the manipulators to move, and the angle information of the joints of the manipulators are transmitted to the active rehabilitation training host computer. Positions of the tail end agent balls in the game scene are calculated by using a kinematics equation. The positions of the balls are continuously updated to provide visual information for the patient.

Figure 4:
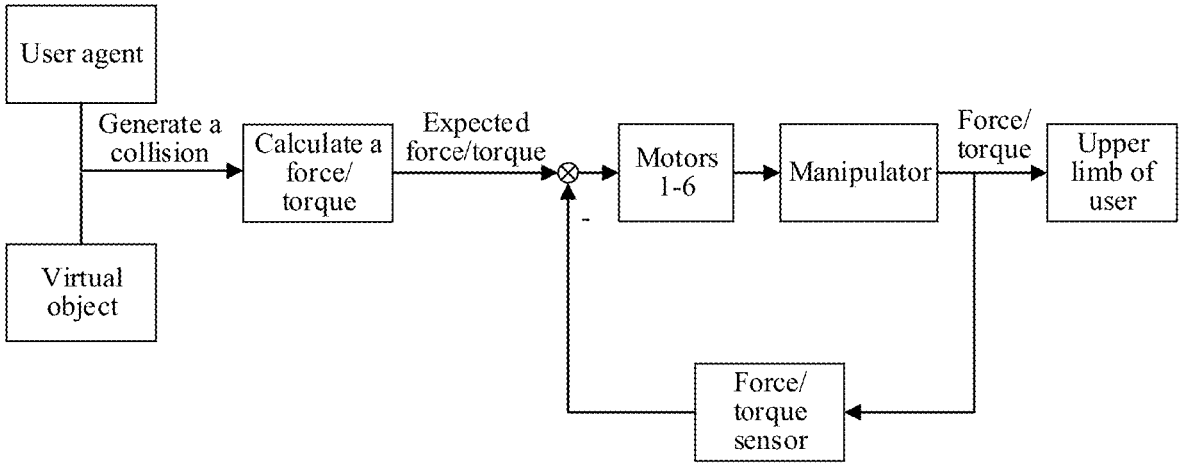
FIG. 4 is a control diagram of implementing precise force feedback by a system.

In addition, in the active rehabilitation training process, the system can further provide precise force feedback for the patient, so that the patient can feel the force when holding the manipulators for training. The rehabilitation game is more vivid and real through dual stimulation of visual information and force information, thereby improving training enthusiasm of the patient. FIG. 4 is a control diagram of implementing precise force feedback by a robot system for active and passive upper limb rehabilitation training according to the present invention. In the active training process, if the system detects a collision between the tail end agent and a virtual object, the system calculates a force/torque according to a collision algorithm, calculates an expected force/torque to each joint of the manipulator by using a statics equation, and at the same time, sends a corresponding control instruction to the motor. To ensure precision of the force feedback at the tail end of the manipulator, a detected signal of the force/torque sensor at the tail end of the manipulator is used as a feedback signal, to adjust a working state of the motor in real time, thereby providing the patient with a more precise and real force feedback feeling.

Flexibility and coordination of the upper limbs of the patient are analyzed according to information recorded in the training process (such as a task completion duration), and a rehabilitation effect is scored. After the rehabilitation effect is scored a plurality of times, a line graph of the active rehabilitation effect of the patient can be obtained.

In conclusion, in the robot system for active and passive upper limb rehabilitation training based on a force feedback technology provided in the present invention, the robot system is directly worn on the waist of a person through the man-machine integration design. The person holds the tail ends of the two manipulators extending from the waist, to complete some active and passive upper limb rehabilitation training for shoulder joint adduction and abduction, shoulder joint extension and flexion, elbow joint flexion and extension. Secondly, the flexibility of the upper limbs of the patient can be gradually enhanced through active and passive rehabilitation training without an additional somatosensory device. Moreover, in the active training process, the system provides real-time force feedback for the upper limb by using the manipulator according to the interaction between the patient and the rehabilitation game, and improves the rehabilitation training effect through dual stimulation of the visual information and the force information. Specific training content such as the angle of the motion joint during passive rehabilitation and the form and difficulty of the task during active training may be modified and customized according to an actual condition of the patient.

What is claimed is:

1. A robot system for active and passive upper limb rehabilitation training based on a force feedback technology, comprising:

a robot body, comprising a pair of multi-degree-of-freedom manipulators configured for placing hands of a patient and a plurality of motor units, wherein a force/torque sensor is mounted on a tail end of each manipulator of the pair of multi-degree-of-freedom manipulators;

an active and passive training host computer system for an active rehabilitation training and/or a passive rehabilitation training, wherein when the robot system provides the passive rehabilitation training, the hands of the patient are supported by the tail end of each of the manipulators, and the host computer system calculates an expected position track of the tail end of each of the manipulators into a motion angle of at least one of the motor units according to a rehabilitation training action, and controls each of the manipulators to draw an upper limb to complete a training task set by the robot system; and when the robot system provides the active rehabilitation training, a virtual rehabilitation training scene is provided by a man-machine interaction interface, each of the manipulators serves as an interface for a man-machine interaction, the hands of the patient are adapted to control the tail end of each of the manipulators to move, and the robot system enables the patient to interact with the virtual rehabilitation training scene by using a visual feedback and a force feedback, to complete a task in the virtual rehabilitation training scene; and wherein the active rehabilitation training comprises force feedback information, wherein a presentation manner of the force feedback information is that: the hands of the patient are adapted to control, by using the tail end of each of the manipulators, the virtual hands in the man-machine interaction interface to collide with a virtual object, the host computer system calculates force/torque information generated through a collision according to an algorithm, and allocates a force/torque to each of the motor units through statics analysis of each of the manipulators, and each of the manipulators presents a force on the upper limb of the patient, and allows the patient to feel the force during the active rehabilitation training.

2. The robot system for active and passive upper limb rehabilitation training according to claim 1, wherein the robot body is adapted to be worn on a human body by employing a detachable part.

3. The robot system for active and passive upper limb rehabilitation training according to claim 2, wherein the detachable part is a belt, and the pair of multi-degree-of-freedom manipulators are respectively mounted on opposite sides of the belt.

4. The robot system for active and passive upper limb rehabilitation training according to claim 1, wherein the passive rehabilitation training comprises:

calculating, by the host computer system according to the rehabilitation training action, the expected position track of the tail end into a plurality of motion angles of each of the manipulators by using an inverse kinematics calculation formula of each of the manipulators, and storing the plurality of motion angles in the host computer system;

driving, by each of the manipulators, to make the upper limb perform a training according to a specified rehabilitation action until a specified quantity of times of training is reached; and analyzing, by the host computer system, an accuracy level of an action of the upper limb of the patient according to feedback information provided from data transmitted by the robot body from each of the motor units to the host computer system in a training process, and scoring a rehabilitation effect, to obtain a line graph of a passive rehabilitation effect of the patient after the rehabilitation effect is scored a plurality of times.

5. The robot system for active and passive upper limb rehabilitation training according to claim 4, wherein the feedback information from each of the motor units comprises an angle of a plurality of joints of each of the manipulators and/or a current provided to each of the motor units.

6. The robot system for active and passive upper limb rehabilitation training according to claim 1, wherein the active rehabilitation training comprises visual feedback information, wherein a presentation manner of the visual feedback information is that: the man-machine interaction interface of the robot system displays a scene of a rehabilitation training task and virtual hands of the patient, positions of the virtual hands change with positions of the hands of the patient, the positions of the virtual hands are obtained through a calculation by the host computer system by using a forward kinematics calculation formula of each of the manipulators according to angle information of a plurality of joints of each of the manipulators, and the man-machine interaction interface continuously updates the positions of the hands of the patient to provide the visual feedback information for the patient; and a rehabilitation condition of the upper limb of the patient is analyzed, by the host computer system, according to information recorded in a training process, and a rehabilitation effect is scored, to obtain a line graph of an active rehabilitation effect of the patient after the rehabilitation effect is scored a plurality of times.

* * * * *